US006119906A

United States Patent [19]

Bond et al.

[11] Patent Number: 6,119,906

[45] Date of Patent: Sep. 19, 2000

[54] HANGER WITH INTEGRATED CLIPS

[75] Inventors: Steve Bond, Hauppauge, N.Y.; Michael Hawkins, Chester, United Kingdom

[73] Assignee: Red Wing Products, Inc., Brentwood, N.Y.

[21] Appl. No.: 09/257,480

[22] Filed: Feb. 25, 1999

[51] Int. Cl.[7] ..... A47G 25/48

[52] U.S. Cl. ..... 223/96

[58] Field of Search ..... 223/85, 95, 96, 223/92, 90, 91, 88

[56] References Cited

U.S. PATENT DOCUMENTS

| | | | |
|---|---|---|---|
| D. 146,998 | 6/1947 | Townsend et al. | 223/96 |
| D. 185,716 | 7/1959 | Nalle, Jr. | 223/96 |
| D. 243,138 | 1/1977 | Coon | 223/96 |
| 1,081,058 | 12/1913 | Owens | 223/96 |
| 2,939,588 | 6/1960 | Nalle, Jr. | 223/96 |
| 3,946,915 | 3/1976 | Crane | 223/96 |
| 4,009,807 | 3/1977 | Coon | 223/96 |
| 4,802,265 | 2/1989 | Stevenson | 223/96 |
| 5,212,854 | 5/1993 | Hollis | 223/96 |
| 5,400,932 | 3/1995 | Hollis | 223/96 |
| 5,516,014 | 5/1996 | Garrison | 223/96 |

FOREIGN PATENT DOCUMENTS

| | | | |
|---|---|---|---|
| 152254/92 | 12/1992 | Australia | 223/96 |

*Primary Examiner*—Bibhu Mohanty

*Attorney, Agent, or Firm*—Francis C. Hand, Esq.; Carella, Byrne, Bain, Gilfillan, Cecchi, Stewart & Olstein

[57] ABSTRACT

The plastic hanger is provided with a cross-bar of S-shape cross-section and a pair of clips. One jaw of each clip is integrally molded with the cross-bar while the opposed jaw is separately molded and held in place by a spring clip which biases the clamping ends of the jaws together. The cross-bar is provided with spacers at the ends to space adjacent hangers apart. The upper finger-receiving end of the jaw integrated with the cross-bar is contoured and provided with a shoulder to give the appearance that the upper end of the jaw is separate from the cross-bar.

25 Claims, 3 Drawing Sheets

HANGER WITH INTEGRATED CLIPS

This invention relates to a hanger with integrated clips.

As is known, various types of hangers have been constructed for the hanging of garments for purposes of transportation and/or for display in retail establishments. In many cases, the hangers are provided with clips on two ends of a cross-bar in order to engage and hold a garment in a depending manner. In the case of hangers which are basically made of plastic materials several constructions have been known to integrate the clips into the bodies of the hangers.

U.S. Pat. No. 4,009,607 describes a garment hanger formed with a single cross-bar having clips at each end which clamp and center a garment directly beneath the cross-bar. Each clip has one jaw integrally formed with the cross-bar in an offset manner and a second discrete jaw which pivots on a rib on the first jaw. In addition, a spring holds the two jaws together and biases the jaws together at their clamping ends.

One of the problems associated with a hanger of this type is that the jaws project sideways from the cross-bar. Accordingly, when rows of such hangers are mounted on a rail or sales display rack, the jaws of adjacent hangers come into contact so that any unwarranted movement of the hangers on the rail (or rack) may cause the jaws to separate and garments supported by the hangers to become loose or to fall from the jaws. Another problem is that the jaw which is integrated with the cross-bar is not perceived by a customer as one which can be readily pinched for opening of the jaws to remove or to rehang a garment but rather is perceived as being a rigid part of the cross-bar.

Other garments hangers are also known in which both jaws of a clip are integrally formed, as by a molding operation, with the cross-bar of the hanger. In such cases, after molding the jaws are typically folded over each other and a separate discrete clip is snapped over the two jaws in order to secure the jaws together.

One problem with this type of hanger is that the spring clip is generally movable between a locking position to clamp the jaws onto a garment and a release position to unclamp the jaws to allow a garment to be removed from between the jaws. As a result, this type of hanger is rather cumbersome to use. Further, such hangers are more complex to mold particularly with respect to molding a hinge between the two jaws in order to connect the two jaws together and to permit a subsequent folding over of one jaw on the other.

Accordingly, it is an object of the invention to provide a hanger made of rigid construction with integrated clips.

It is another object of the invention to provide a hanger made of easily moldable parts which can be readily assembled together.

It is another object of the invention to provide a plastic hanger with integrated clips simulating the appearance of separately mounted clips.

Briefly, the invention is directed to a hanger having an elongated cross-bar and a pair of garment-engaging clips, wherein each clip has one jaw integral with and disposed on one end of the cross-bar and a second discrete jaw which is disposed in facing relation to the integral jaw for engaging a garment therebetween. Still further, the hanger includes a pair of springs, each of which biases the lower ends of a jaw together.

In accordance with the invention, the cross-bar of the hanger and the integral jaws form a one piece body which is readily molded with a pair of integral spacers, each of which is disposed at a respective end of the cross-bar and each of which projects laterally from the cross-bar. These spacers project beyond the plane of the clips and serve to space the hanger from the next adjacent hanger on a support rail or display rack.

The cross-bar and integrated jaws are molded together such that each jaw has a rear wall of predetermined contour disposed within the projected plane of the cross-bar. In this respect, the cross-bar has a rear wall which merges in a co-planar manner into the rear wall of the integrated jaws so that a smooth transition surface is provided between the cross-bar and each integrated jaw. Each discrete jaw is provided with a forward or outside wall of identical contour to the contour of the rear wall of the integrated jaw.

For purposes of rigidity, the cross-bar has a block S-shaped cross section. In this respect, the cross-bar also has a front wall parallel to the rear wall and located vertically above the rear wall and from which the spacers project.

Also, in accordance with the invention, the two jaws of a clip are provided with identical exterior contours so that the outward appearance of the hanger is such that the clips appear to be separate from the cross-bar.

In accordance with the invention, the jaws of each clip are provided with a unique construction to allow for pivoting of the discrete jaw relative to the integrated jaw. To this end, the integrated jaw is provided with a bar to define a pivot axis as well as a post which projects from the bar. The facing discrete jaw is provided with pairs of projecting abutments which pivotally engage the bar for pivoting of the discrete jaw on the bar while one pair of the abutments engages with the post on opposite sides so that the jaws are retained against moving laterally of each other. For purposes of assembly, the post on the integrated jaw allows for rapid alignment of a discrete jaw on and with an integrated jaw prior to positioning of the spring between the two jaws.

Each jaw of a clip also includes a recess in an outwardly directed face while the spring is typically of U-shape with a pair of legs with each having an inwardly directed hook at a lower end received in the recess of the respective jaw.

The jaws of each clip are also provided with inwardly facing projections on the lower ends in order to grip a garment. By way of example, one jaw has a set of parallel projections while the other jaw has two sets of parallel projections disposed to opposite sides of the projections of the facing jaw. Thus, when a garment is gripped between the two jaws of a clip, the projections on each jaw are out of alignment with each other so that the garment can be somewhat deflected over the projections depending upon the relative thinness of the garment.

These and other objects and advantages of the invention will become more apparent from the following detailed description taken in conjunction with the accompanying drawings wherein.

Figure 1:
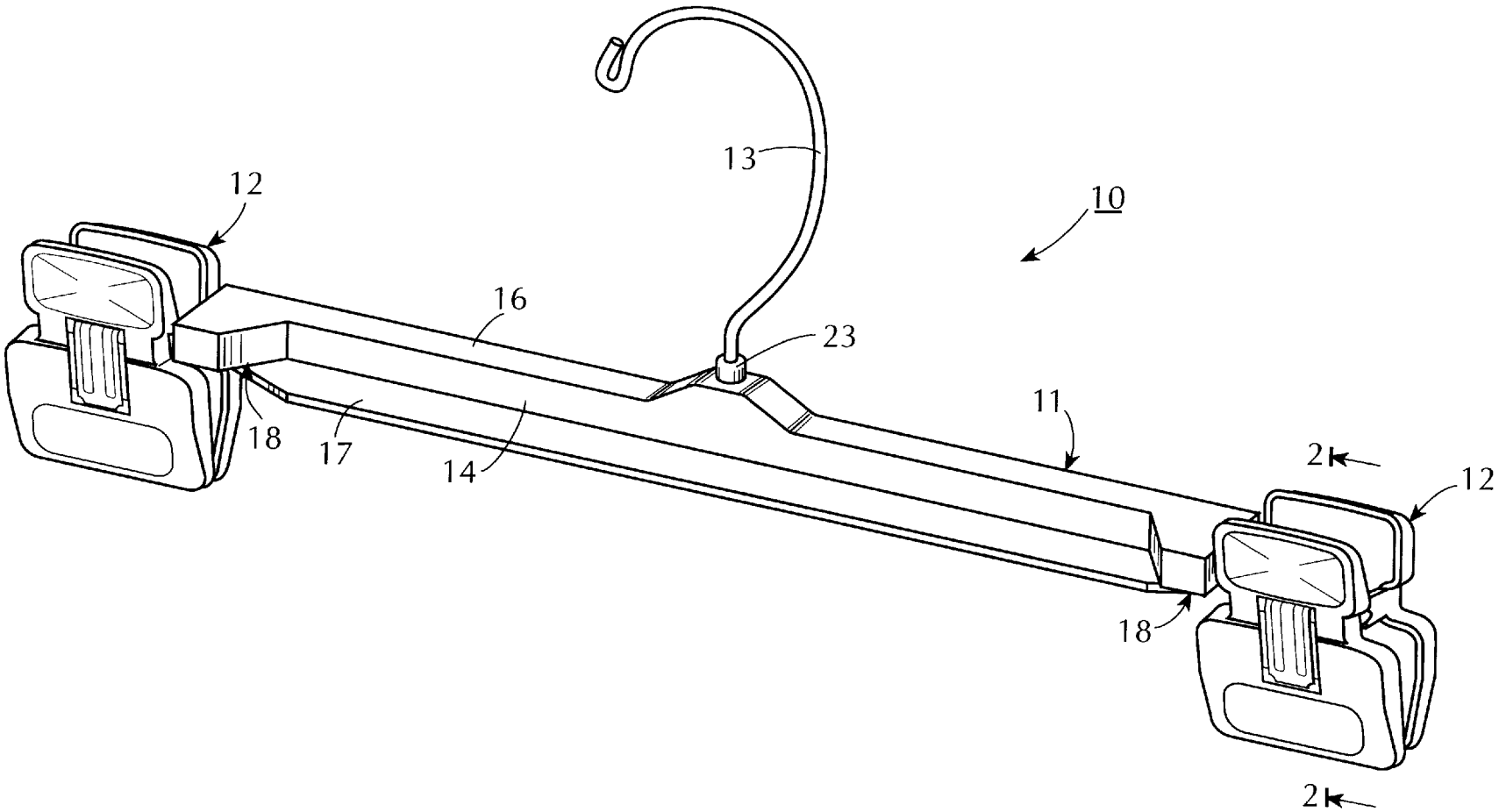
FIG. 1 illustrates a perspective front view of a hanger constructed in accordance with the invention.

Referring to FIG. 1, the hanger 10 includes a cross-bar 11, a pair of clips 12 and a hook 13. In this embodiment, the cross-bar 11 is made of plastic while the hook 13 is made of metal.

Figure 6:
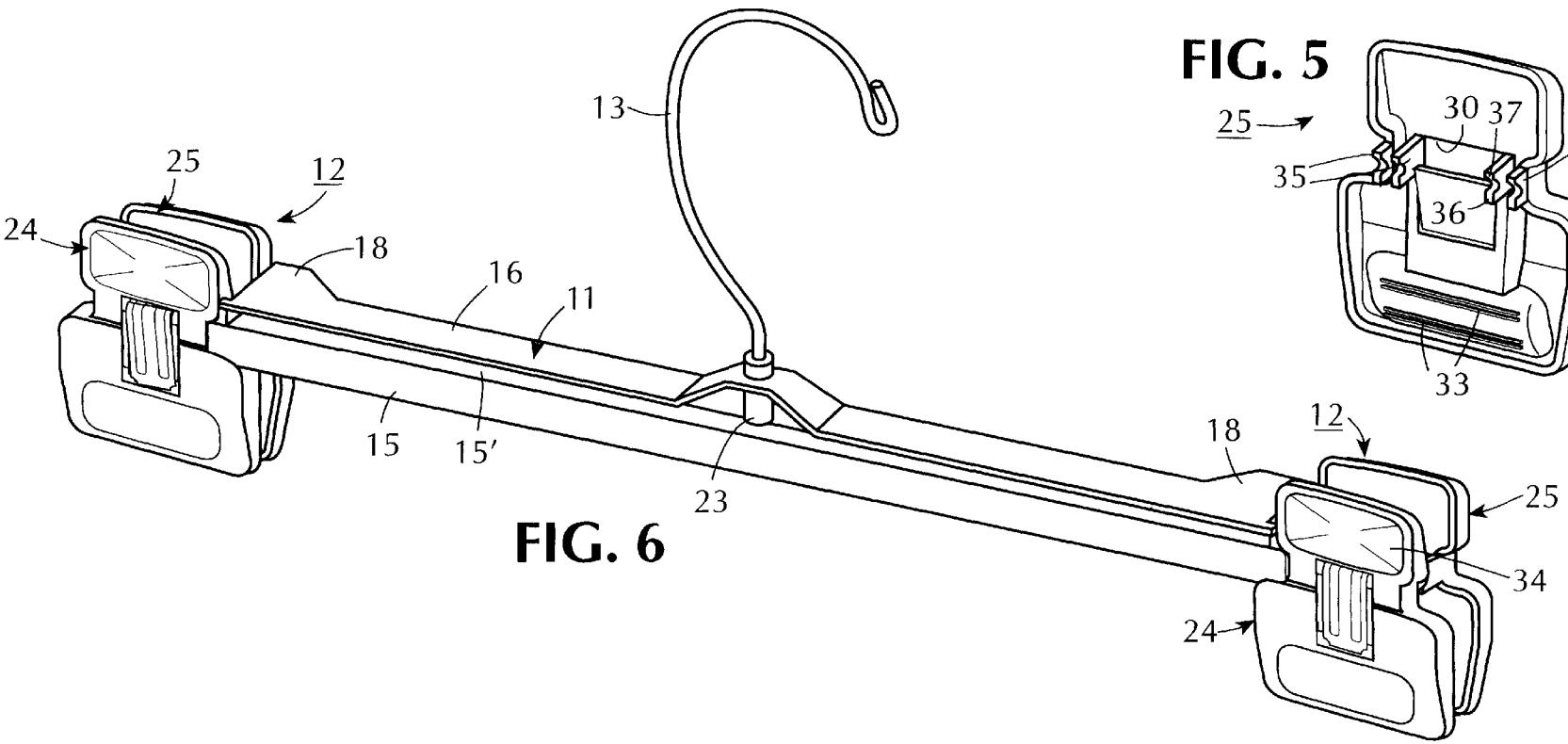
FIG. 6 illustrates a back view of the hanger of FIG. 1.

The cross-bar 11 is elongated along a longitudinal axis and has a block S-shaped cross-section defined, in part, by a front vertical wall 14 and a rear vertical wall 15 (FIG. 6) which are interconnected by a common transverse web 15' (FIG. 6). In addition, the cross-bar 11 has an upper horizontal flange 16 extending from the front wall 14 and a bottom flange 17 extending from the rear wall 15. Typically, the cross-section is symmetrical about the common transverse web 15= to balance the weight of the hanger particularly for holding purposes.

Figure 3:
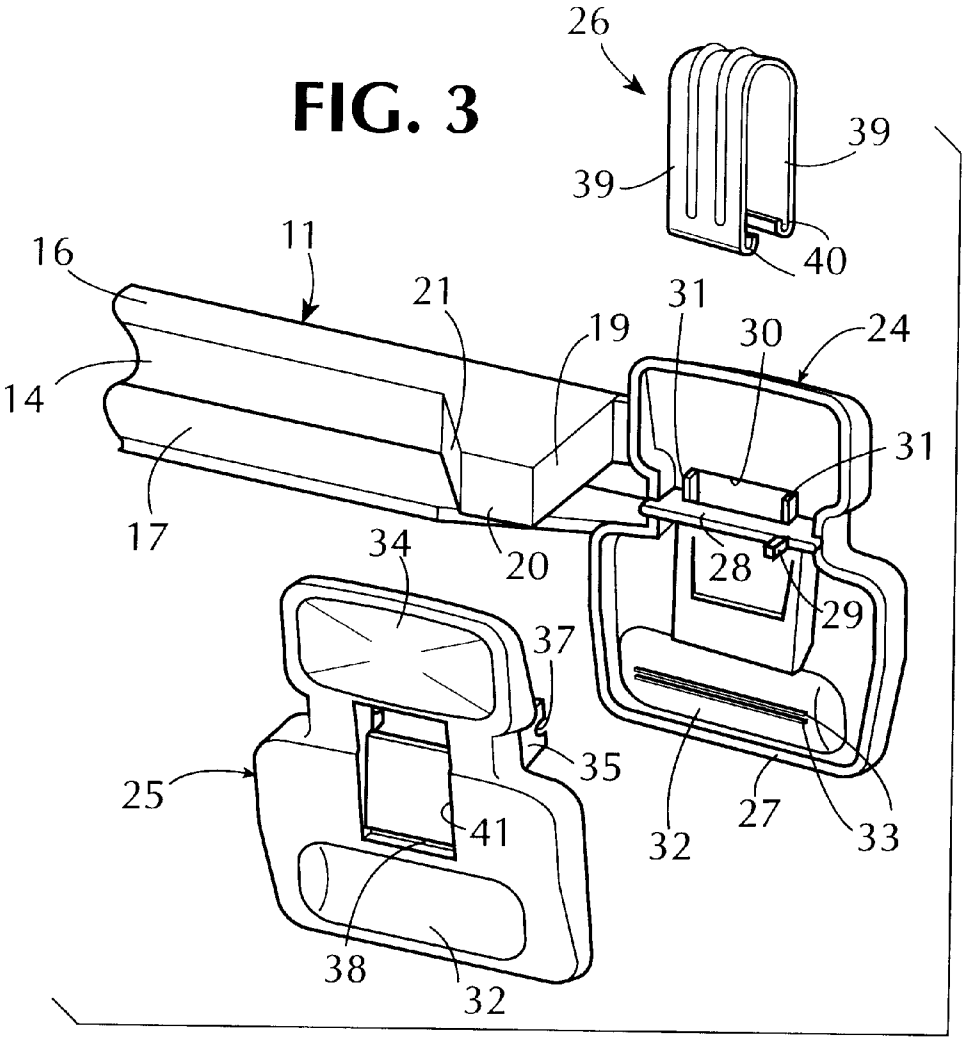
FIG. 3 illustrates an exploded view of a clip at the end of the hanger.

The cross-bar 11 is also provided with a pair of spacers 18, each of which is disposed 11 adjacent an end of the cross-bar 11 and each of which projects laterally of the cross-bar 11. Each spacer 18 is formed by extensions of the front wall 14, top flange 16 and intermediate web (not shown) of the cross-bar 11. As indicated FIG. 3, each spacer 18 has a flat side wall 19 extending substantially perpendicularly of the longitudinal axis of the cross-bar 11, a forward flat face 20 and an inclined side wall merging into the front wall 14. The flat side wall 21 is spaced from the adjacent clip 12 to define a small gap therebetween. The flat side wall 21 is at a slight angle from the perpendicular to the axis of the cross-bar 11 for molding purposes. As shown in FIG. 3, a small web 22 extends perpendicularly from the side wall 21 of the spacer 18 into and integrally with the clip 12.

The hook 13 is anchored in the cross-bar 11 in any suitable manner. For example, the cross-bar 11 may be provided with a cylindrical well 23 for receiving the lower part of the hook 13 in rotatable relation. Typically, the well 23 and thus the hook 13 are disposed on the longitudinal axis of the cross-bar 11.

Referring to FIG. 3, each clip 12 is formed of two jaws 24, 25 which are pivotally mounted with respect to each other and a spring clip 26 which biases the lower clamping ends of the jaws 24, 25 together.

One jaw 24 is integrally formed with the cross-bar 11. As shown, the integral jaw 24 has an enlarged lower clamping end of rectangular shape and a reduced upper finger-receiving end of T-shape. The jaw 24 also has a raised rib 27 which defines the outer peripheral edge of the jaw 24 and which tapers down along the upper edge of the jaw 24 to define a very slight raised portion. As indicated, the front wall 14 and lower flange 17 of the cross-bar 11 merge into the raised rib 27 of each jaw 24 along with the web 22 from the spacer 18.

The jaw 24 includes a bar 28 which defines a pivot axis for the discrete jaw 25. As illustrated, the bar 28 extends across the width of the jaw 24 in the upper finger-receiving end of the jaw 24. In addition, a post 29 projects horizontally from the bar 28 for purposes as described below.

The jaw 24 also has an opening 30 above the bar 28 for passage of the spring clip 26, as described below. This opening 30 is flanked by a pair of abutments 31 on the inside surface which abutments serve to guide the spring clip 26 into the opening 30 while rigidifying the jaw 24.

The jaw 24 also has a deformed portion 32 in the lower clamping end which forms a depression in the outwardly directed face of the jaw 24 as well as a projection on the inwardly directed face. As indicated in FIG. 3, the deformed portion 32 is provided with a set of parallel projections 33, for example, three projections, for gripping a garment.

Figure 5:
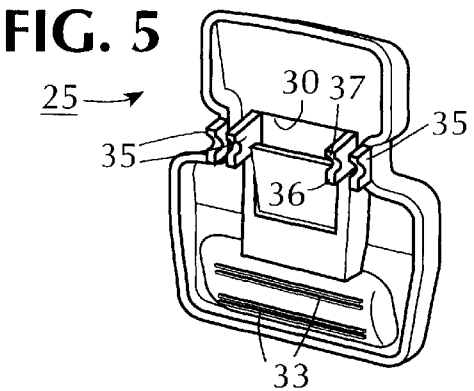
FIG. 5 illustrates a view of the inside of the discrete jaw constructed in accordance with the invention.

Referring to FIGS. 3 and 5, wherein like reference characters indicate like parts as above, the discrete jaw 25 is provided with an outside contour identical to that of the opposed jaw 24. In addition, the discrete jaw 25 has an opening 30 for receiving the spring clip 26, as does the opposed jaw 24, and the outside face of the upper finger-receiving end has a shaped cavity 34 to receive a thumb or forefinger of a user as does the opposed jaw 24.

Referring to FIG. 5, the discrete jaw 25 has two pairs of projecting abutments 35 for pivotally engaging the bar 28 of the integrated jaw 24. As shown, each abutment 35 has a horizontal lower wall 36 and an opposed angularly disposed wall 37 to define a rounded groove for receiving the bar 28.

As illustrated in FIG. 5, the abutments 35 of each pair of abutments 35 are slightly spaced apart and one pair of abutments 35 are spaced so as to receive the post 29 which projects from the pivot bar 28 of the integrated jaw 24. When the post 29 is in place between a pair of abutments 35, the jaws 24, 25 are retained laterally of each other so that the discrete jaw 25 can not move from side to side on the integrated jaw 24.

The deformed portion 32 of the discrete jaw 25 has two sets of parallel projections 33 with each set having two projections 33. As indicated in FIG. 2, the two sets of projections 33 on the discrete jaw 25 are disposed to opposite sides of the set of projections 33 on the integrated jaw 24 so that a garment which is gripped between the two jaws 24, 25 can be slightly deflected over the three sets of projections 33 in order to enhance the gripping effect of the jaws 24, 25 on the garment.

Referring to FIG. 3, the discrete jaw 25 includes a recess 38 in the outwardly directed face which is identical to a recess 38 in the outer face of the opposed jaw 24 for purposes as described below.

Figure 2:
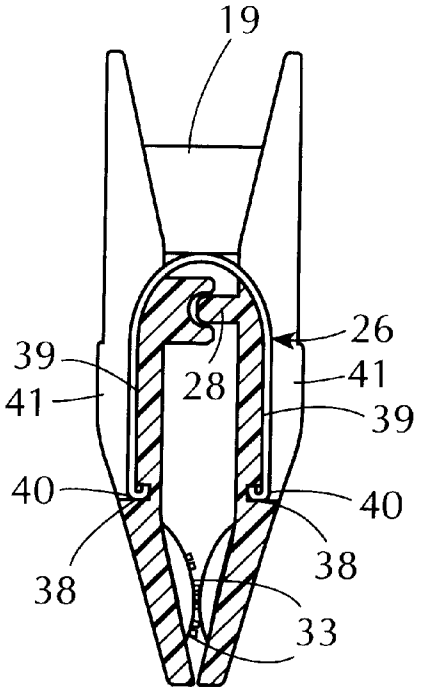
FIG. 2 illustrates a part cross-sectional view of a jaw of the hanger in accordance with the invention.

Referring to FIGS. 2 and 3, each spring clip 26 is of U-shape and has a pair of legs 39 to define a U-shape which pass through the apertures 30 of the respective jaws 24, 25 to hingedly secure a discrete jaw 24 to a facing integral jaw 25 on the cross-bar 11. In addition, each leg 39 has an inwardly directed hook 39 of J-shape at a lower end which is received in a recess 37 of a respective jaw 24, 25 in snap-fit relation. As indicated in FIG. 2, the outer face of each jaw 24, 25 is provided with a recess 41 for receiving a leg 39 of the spring clip 26 in a recessed manner. In this way, the surfaces of the spring clip 26 are fully within the outer contour of the clip 12 (see FIG. 1) so that a considerable manual effort would be required along with a tool in order to remove the spring clip 26 from the jaws 24, 25.

The hanger 10 may be manufactured in a relative simple manner. For example, the cross-bar 11 and integrated jaws 24 are molded in one piece in a suitable injection molding process. In this respect, the various contours and shapes of the jaws 24 and cross-bar 11 can be readily accomplished in a mold, such as in an injection mold.

The discrete jaws 25 are separately molded, for example, in an injection mold with the various shapes and contours being easily accommodated within the mold.

After molding, the one piece body constituting the cross-bar 11 and integrated jaws 24 is placed in a suitable fixture and a pair of the discrete jaws 25 are positioned opposite the integrated jaws 24. In this respect, the abutments 34 on each discrete jaw 25 are positioned on the bar 28 of the integrated jaw 24 with the post 29 of the integrated jaw 24 positioned between two of the abutments 35. Thus, the discrete jaws 24 are held against lateral displacement along the bars 28 of the integrated jaws. Next, the spring clips 26 are dropped into place through the openings 30 of the jaws 24, 25 and the hooks 40 on the legs 39 of the spring clips 26 are snapped into the respective recesses 38 of the jaws 24, 25 in a permanent manner.

Thereafter, the hook 13 can be mounted in the well 23 of the cross-bar 11 and the hanger shipped to a point of use.

Figure 4:
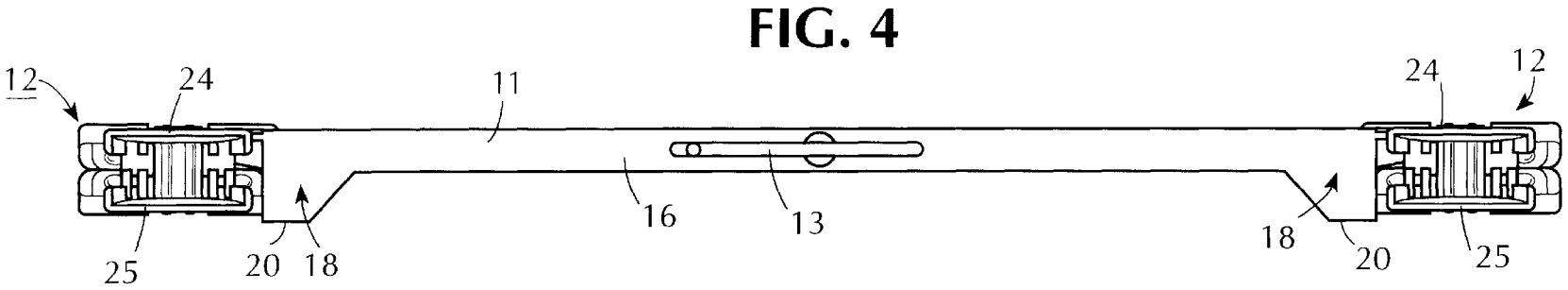
FIG. 4 illustrates a top view of the hanger of FIG. 1 with one of the discrete jaws removed.

Referring to FIG. 4, the jaws 24, 25 of a clip 12 are disposed within the projected plane of the spacers 18. That is to say, each spacer 18 projects slightly outwardly of the adjacent clip 12 so as to abut against the rear of a similar hanger 10 when mounted on a rail or sales display rack. In this way, the clips 12 of adjacent hangers 10 are prevented from coming into contact with each other. Typically, the flat faces 20 of the spacers 18 are in a common plane parallel to the longitudinal axis of the cross-bar 11 and at least the upper end of each discrete jaw 25 is located between this plane and the axis of the cross-bar 11.

While one jaw 24 of a clip 12 is integral with the cross-bar 11, the outward appearance of the jaws 24, 25 is such that the entire clip 12 appears to be separate from the cross-bar. For example, as shown in FIG. 6, while the integrated jaw 24 is connected over a substantial height to the cross-bar 11, for example, the rear wall 15 of the cross-bar 11 merges directed into the lower clamping end as well as the upper finger-receiving end of the jaw 24, a shoulder 42 is formed during molding between the upper end of the jaw 24 and the cross-bar 11 to give the appearance that the upper end of the jaw 24 is separate from the cross-bar 11 when, in fact, the upper end of the jaw 24 is integral with the cross-bar 11.

As shown in FIG. 4, the pivot axis for each discrete jaw 25 as defined by the bar 28 of the opposed jaw 24 is located laterally outwardly of the main longitudinal axis of the cross-bar 11. That is to say, a garment hanging from the hanger 10 has a center of gravity which would be offset slightly from the plane of the hook 13 and the longitudinal axis of the cross-bar 11. However, any tilting of the hanger 10 from a true vertical plane is compensated by the spacers 18 of the hanger 10 abutting against an adjacent hanger on a display rack or rail.

When in use, a plurality of hangers 10 are mounted on a rack with garments depending therefrom. Typically, the hanger 10 grips a garment between the jaws 24, 25 such that the gripped portion of the garment is of a thickness less than the width of the spacers 18 on the hanger 10. Thus, should a large number of hangers 10 be pushed together on a rack, the spacers 18 of the respective hangers 10 serve to maintain when the upper ends of the secured garments in spaced apart relation. This, in turn, reduces the risk that removal of a garment and hanger from the rack might be blocked by an adjacent hanger.

As shown in FIG. 1, the jaws 24, 25 of each clip 12 are disposed below the plane of the block S-shaped cross-bar 11. Thus, when a garment is suspended from the clips 12, the flat front wall 14 of the cross-bar 11 is exposed to view. Accordingly, advertising and other indicia may be printed, molded or otherwise provided on the front wall 14.

One advantage of the construction of the hanger is that the jaw 24 which is integrated with the cross-bar is rigidified. Thus, in effect, only the discrete jaw 25 is pivoted in order to release or secure a garment. This, in turn, simplifies the manipulation required by the customer or user while at the same time giving the appearance that the integrated jaw is separate from the cross-bar 11.

The invention thus provides a hanger which is of rigid construction with integrated clips. Further, the invention provides a hanger which can be made of easily moldable parts and which can be readily assembled together.

Still further, the invention provides a plastic hanger with integrated clips which simulate the appearance of separately mounted clips.

What is claimed is:

1. A hanger comprising a one piece body having an elongated cross-bar, a pair of integral jaws, each jaw being disposed on an opposite end of said cross-bar from the other jaw, and a pair of spacers, each spacer being disposed adjacent a respective end of said cross-bar and projecting laterally of said cross-bar;

a pair of discrete jaws, each discrete jaw being disposed in facing relation to a respective integral jaw of said body for engaging a garment therebetween, each discrete jaw being disposed laterally within a projected plane of said spacers; and a pair of springs, each spring biasing a lower end of a respective one of said discrete jaws against a lower end of a facing one of said integral jaws of said body.

2. A hanger as set forth in claim 1 where said cross-bar has a block S-shaped cross-section with a front vertical wall and a rear vertical wall.

3. A hanger as set forth in claim 1 wherein said cross-bar has a rear wall and each integral jaw has a rearmost wall in said plane.

4. A hanger as set forth in claim 3 wherein each integral jaw has a rear wall of predetermined contour and each discrete jaw has a forward wall of identical contour to said predetermined contour.

5. A hanger as set forth in claim 1 wherein each integral jaw has a forwardly projecting bar defining a pivot axis parallel to said common plane and each discrete jaw has a pair of rearwardly projecting abutments pivotally engaging said bar for pivoting of said respective discrete jaw on said pivot axis.

6. A hanger as set forth in claim 5 wherein said cross-bar is disposed along a longitudinal axis parallel to and laterally spaced from said pivot axis.

7. A hanger as set forth in claim 1 wherein each said integral jaw has a set of parallel projections and each said discrete jaw has two sets of parallel projections disposed to opposite sides of said projections of a facing integral jaw.

8. A hanger comprising an elongated cross-bar having a pair of spacers, each spacer being disposed adjacent a respective end of said cross-bar and projecting laterally of said cross-bar;

a first pair of jaws, each jaw being integral with and disposed on an opposite end of said cross-bar from the other jaw;

a pair of discrete jaws, each discrete jaw being disposed in facing relation to a respective integral jaw on said body for engaging a garment therebetween, each discrete jaw being disposed laterally within a projected plane of said spacers; and a pair of springs, each spring biasing a respective one of said discrete jaws against a facing one of said integral jaws of said body.

9. A hanger as set forth in claim 8 where said cross-bar has a block S-shaped cross-section.

10. A hanger as set forth in claim 9 wherein said cross-bar has a rear wall in a vertical plane and each integral jaw has a rearmost wall in said plane.

11. A hanger as set forth in claim 10 wherein said rearmost wall of each integral jaw has a predetermined contour and each discrete jaw has a forward wall of identical contour to said predetermined contour.

12. A hanger as set forth in claim 8 wherein each jaw of said first pair of jaws has an enlarged lower clamping end of rectangular shape and a reduced upper finger-receiving end of T-shape.

13. A hanger as set forth in claim 12 wherein said cross-bar merges into said lower clamping end and said upper end of each jaw of said first pair of jaws.

14. A hanger as set forth in claim 13 which further comprises a shoulder between said upper end of a respective jaw of said first pair of jaws and said cross-bar to give the appearance that said upper end of a respective jaw of said first pair of jaws is separate from said cross-bar.

15. A hanger comprising an elongated cross-bar having a pair of spacers, each spacer being disposed adjacent a respective end of said cross-bar and projecting laterally of said cross-bar;

a first pair of jaws, each jaw being integral with and disposed on an opposite end of said cross-bar from the other jaw and having a rear wall of predetermined contour;

a pair of discrete jaws, each discrete jaw being disposed in facing relation to a respective integral jaw of said body and laterally within a projected plane of said spacers for engaging a garment therebetween and having a forward wall of identical contour to said predetermined contour; and a pair of springs, each spring biasing a respective one of said discrete jaws against a facing one of said integral jaws on said body.

16. A hanger as set forth in claim 15 where said cross-bar has a block S-shaped cross-section.

17. A hanger as set forth in claim 16 wherein said cross-bar has a rear wall in a vertical plane and each integral jaw has a rearmost wall in said plane.

18. A hanger as set forth in claim 15 wherein each said integral jaw has a bar defining a pivot axis parallel to said common plane and each discrete jaw has a pair of abutments pivotally engaging said bar for pivoting of said respective discrete jaw on said pivot axis.

19. A hanger as set forth in claim 18 wherein said cross-bar is disposed along a longitudinal axis parallel to and laterally spaced from said pivot axis.

20. A hanger as set forth in claim 15 wherein each said integral jaw has a set of parallel projections and each said discrete jaw has two sets of parallel projections disposed to opposite sides of said projections of a facing integral jaw for engaging a garment therebetween.

21. A hanger as set forth in claim 15 wherein each jaw of said first pair of jaws has an enlarged lower clamping end of rectangular shape and a reduced upper finger-receiving end of T-shape.

22. A hanger as set forth in claim 21 wherein said cross-bar merges into said lower clamping end and said upper end of each jaw of said first pair of jaws.

23. A hanger as set forth in claim 22 which further comprises a shoulder between said upper end of a respective jaw of said first pair of jaws and said cross-bar to give the appearance that said upper end of a respective jaw of said first pair of jaws is separate from said cross-bar.

24. A hanger comprising a one-piece body defining a cross-bar; a pair of integral jaws, each jaw being disposed at a respective end of said cross-bar; and a pair of integral spacers, each spacer being disposed at a respective end of said cross-bar and projecting laterally from said cross-bar; and a pair of discrete jaws, each discrete jaw being pivotally mounted on a respective integral jaw and being disposed within a projected plane of a respective spacer.

25. A hanger as set forth in claim 24 having a hook mounted on a longitudinal axis of said cross-bar and wherein each discrete jaw is pivotally mounted on a pivot axis located laterally outwardly of said longitudinal axis of said cross-bar whereby a garment hanging from the hanger has a center of gravity offset from said longitudinal axis of said cross-bar.

* * * * *

UNITED STATES PATENT AND TRADEMARK OFFICE

CERTIFICATE OF CORRECTION

PATENT NO. : 6,119,906

DATED : September 19, 2000

INVENTOR(S) : Steve Bond, et. al.

It is certified that error appears in the above-indentified patent and that said Letters Patent is hereby corrected as shown below:

Column 3, line 9 change "15=" to -15' -

Signed and Sealed this

Tenth Day of April, 2001

*Attest:*

Nicholas P. Godici

NICHOLAS P. GODICI

*Attesting Officer*

*Acting Director of the United States Patent and Trademark Office*